United States Patent [19]

Sensabaugh, Jr. et al.

[11] Patent Number: 4,655,229

[45] Date of Patent: Apr. 7, 1987

[54] FLAVOR DELIVERY SYSTEM

[75] Inventors: Andrew J. Sensabaugh, Jr., Winston-Salem; Henry T. Ridings, Lewisville, both of N.C.

[73] Assignee: R. J. Reynolds Tobacco Company, Winston-Salem, N.C.

[21] Appl. No.: 575,121

[22] Filed: Jan. 30, 1984

[51] Int. Cl.[4] ..... A24D 1/00

[52] U.S. Cl. ..... 131/273; 131/274; 131/335

[58] Field of Search ..... 131/335, 273, 274

[56] References Cited

U.S. PATENT DOCUMENTS

| | | | |
|---|---|---|---|
| 2,445,476 | 7/1948 | Folkman | 131/273 |
| 2,764,154 | 9/1956 | Murai . | |
| 2,907,686 | 10/1959 | Siegel . | |
| 3,200,819 | 8/1965 | Gilbert . | |
| 3,258,015 | 6/1966 | Ellis et al. . | |
| 3,356,094 | 12/1967 | Ellis et al. . | |
| 3,863,644 | 2/1975 | Hunt . | |
| 3,943,941 | 3/1976 | Boyd et al. . | |
| 4,044,777 | 8/1977 | Boyd et al. . | |
| 4,079,742 | 3/1978 | Rainer et al. . | |
| 4,083,372 | 4/1978 | Boden . | |
| 4,171,000 | 10/1979 | Uhle . | |
| 4,284,089 | 8/1981 | Ray . | |
| 4,286,604 | 9/1981 | Ehretsmann et al. . | |
| 4,326,544 | 4/1982 | Hardwick et al. . | |
| 4,393,884 | 7/1983 | Jacobs . | |
| 4,429,703 | 2/1984 | Haber . | |

*Primary Examiner*—V. Millin

*Attorney, Agent, or Firm*—Grover M. Myers

[57] ABSTRACT

A device for delivering flavor utilizing a flavor carrier in powdered form. A preferred embodiment of the system may resemble a conventional cigarette, and includes an overwrap defining a path of airflow through the device, a chamber containing particulate matter, and a means for entraining the particulate matter in the airflow. The overwrap may be a tube, resembling a conventional cigarette in appearance, feel, and draft. A means for entraining the particulate matter may be an intake flow limiter having a passage therein which causes a thin stream of high-velocity air to impinge upon the particulate matter, entraining it in the airflow. Alternately, the entraining means may be a series of baffles or similar components which produce a turbulent airflow, thus entraining the particulate matter. Output means are also provided for eliminating stoppages and for delivering the airflow, with particulate matter entrained therein, to the user.

25 Claims, 8 Drawing Figures

FIG. 1.
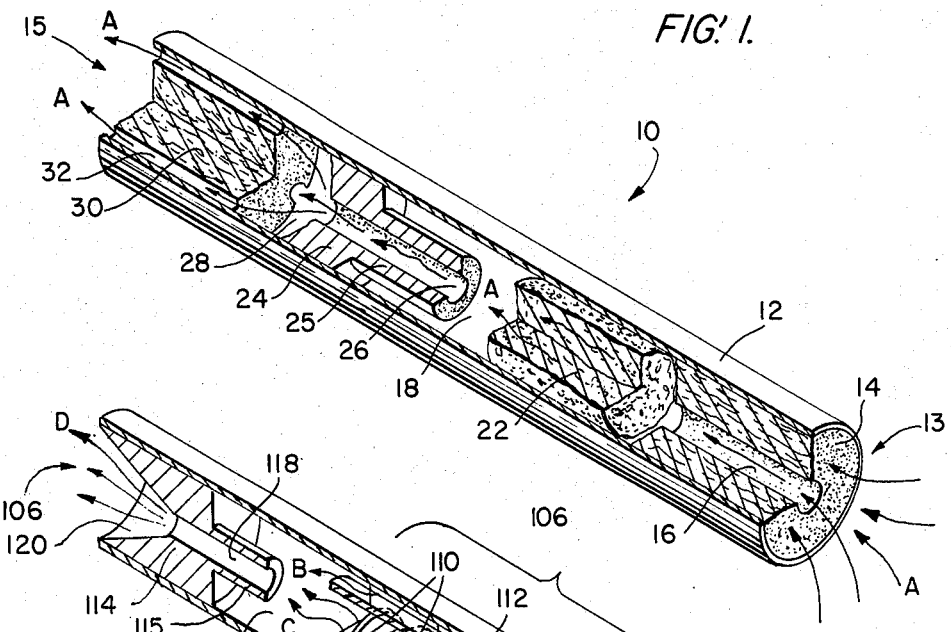
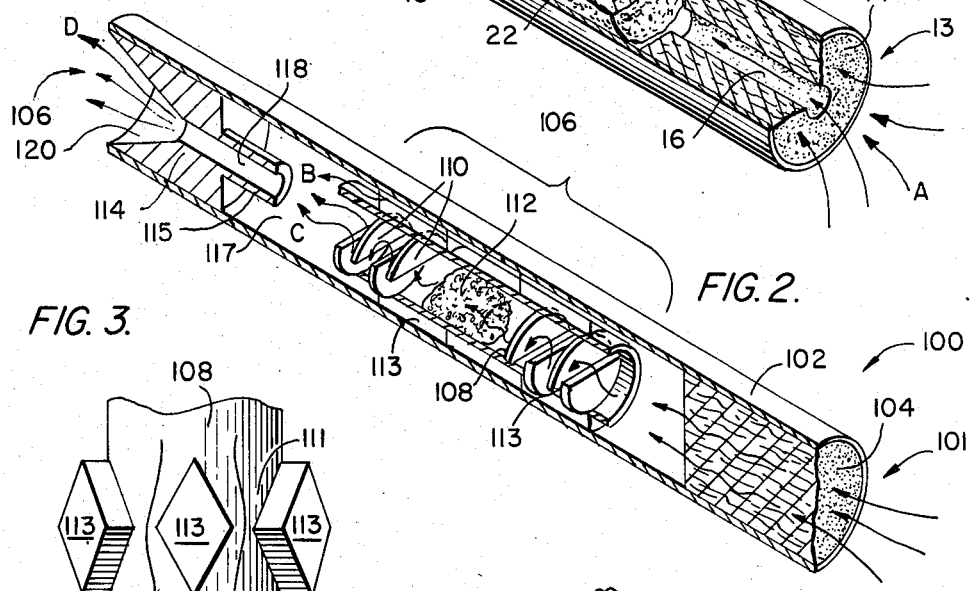
FIG. 2.
FIG. 3.
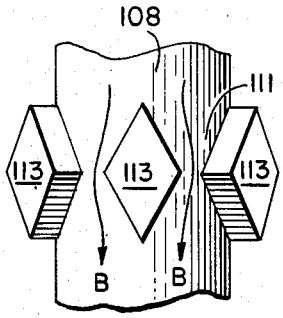
FIG. 5.
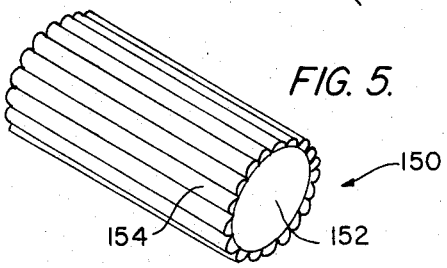
FIG. 4a. FIG. 4b. FIG. 4c. FIG. 4d.
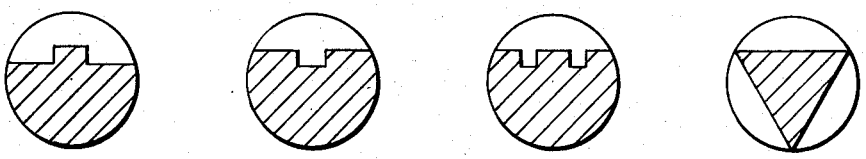

FLAVOR DELIVERY SYSTEM

BACKGROUND OF THE INVENTION

This invention relates to flavor delivery systems, and more particularly to a flavor delivery system suitable as an alternative to conventional cigarettes.

Inventors have been trying to devise a flavor delivery system viable as an alternative to cigarettes for a long period of time. Almost uniformly, however, the prior art has focused upon flavor delivery using vapors or aerosols. For example, see U. S. Pat. Nos. 4,393,884 and 4,171,000.

The prior art relating to viable flavor delivery systems utilizing a powdered flavor delivery system is exceedingly sparse. Indeed, the only such system known to the inventors is dry snuff, normally dispensed by placing a pinch of material in the hand and inhaling same.

Thus, although the art has long sought a viable alternative to cigarettes, apparently no one has discovered a workable means for delivering flavor employing a powder.

SUMMARY OF THE INVENTION

The broad object of the present invention is to provide a device that delivers flavor utilizing a powder flavor delivery system.

Another object of the invention is to provide an article having the appearance and feel of a conventional cigarette, which delivers flavor to consumers employing a delivery system using a powdered flavoring material.

Yet another object of the present invention is to provide a flavor delivery system which lends itself easily to mass manufacturing techniques.

A further object of the invention is to provide a flavor delivery system which gives the consumer the tactile, flavor, and psychological benefits derived from cigarettes while using a powder delivery system to replace smoke.

These and other objects are accomplished in the present invention. The device consists of an overwrap container, having the appearance and feel of a conventional cigarette and defining an airflow path between an intake end and an output end. A quantity of finely ground particulate matter is contained within a particulate chamber inside the overwrap, and means are provided to entrain the particulate matter in the airflow.

The primary advantage of the present invention is the creation of a viable alternative to conventional cigarettes. The product has the appearance and feel of a conventional cigarette; when drawn upon by the consumer, it has the draft characteristics of a conventional cigarette; it delivers desirable taste characteristics; and the particulate matter in the airflow has the appearance of smoke. Thus, the invention offers the consumer the possibility of achieving many psychological advantages associated with cigarettes, using an alternate delivery system.

BRIEF DESCRIPTION OF THE DRAWINGS

FIG. 1 is a pictorial of an embodiment of the invention, sectioned to show the interior components thereof;

FIG. 2 is a pictorial of another embodiment of the invention, sectioned to show the components thereof; the baffle elements are shown unsectioned for clarity;

FIG. 3 is a detailed view of the baffle chamber shown in the embodiment of FIG. 2;

FIGS. 4*a*–4*d* are front views of alternate designs for the baffles employed in the embodiment of FIG. 2;

FIG. 5 is a pictorial of an alternative filter element.

DETAILED DESCRIPTION OF PREFERRED EMBODIMENTS

The general concept of this invention is a product which simulates a cigarette in appearance; it delivers to the user an airflow having particulate matter entrained therein, simulating the taste and tactile characteristics of cigarette smoke. Although many embodiments of such a product are possible within the scope of the present invention, several systems are common to all embodiments. Understanding of the invention will be enhanced, therefore, by first discussing one embodiment and generalizing from that embodiment to discuss the systems shown therein.

Embodiment 10 of FIG. 1 is typical of products produced according to the present invention. The first general system seen in such a product is a container, here in the form of an overwrap, which defines a path of airflow through the product. A paper tube 12, which may be lined with metallic foil, serves this function. In size and appearance, this tube may simulate a conventional cigarette as closely as possible. Also, the tube has an intake end 13, and an output end 15, similar in appearance to conventional filter-tip cigarettes.

The second general system is a means for limiting the airflow through the input end of the product. This system gives the product approximately the same draft as a conventional cigarette. An intake filter 14, carried at the input end of the product, accomplishes this purpose. This element may be manufactured from cellulose acetate or other materials known to the art.

The third system is a chamber, provided to contain the particulate matter to be entrained in the airflow. This chamber may be a void space abaft the intake limiting means, such as the chamber 18.

This chamber contains a quantity of particulate matter 22. The particulate matter consists of a carrier with flavoring material added thereto. Suitable carriers have been found to be substances such as dextrose, and flavorants may be selected from among the wide variety of such materials. Other suitable materials will be obvious to those having skill in the art. About 100 milligrams of material, ground to a fine powder, are used in each device.

Next, there is provided a means for entraining the particulate matter in the airflow. The method employed by this embodiment is a lengthwise bore 16 extending through the filter 14. As the user draws on the product, the negative pressure at the output end causes a thin stream of high-velocity air to flow through the bore and impinge upon the particulate matter. Thus, the airflow within the particulate chamber 18 entrains particulate matter, which is carried toward the output end.

Finally, means are provided for delivering the airflow, with entrained particulate matter, to the user through the output end. Such means must perform several functions: First, some means for metering the quantity of particulate matter is provided, to prevent a mass of particulate matter from clogging the system. Second, an unobstructed flow path is provided to deliver airflow with particulate matter entrained therein to the user in a selected pattern. In embodiment 10, the first element of this system is a stoppage eliminator 24. This cylindrical device is fitted in the tube at the rearward end of the particulate chamber, with its periphery fitted against the inner surface of the tube. A raised cylindrical portion 25 extends into the chamber, and a flow passage 26 passes lengthwise through the eliminator. The raised portion and the flow passage may be coaxial with the eliminator to prevent position bias—the tendency for the product to deliver different particulate concentrations, depending upon how the device is held. Stoppages are prevented, and a metered quantity of particulate matter is delivered, because particulate matter cannot pile up around the opening of the flow passage 26. It has been found that simply providing a cylindrical member with a flow passage but no raised portion permits such piling up, resulting in frequent stoppages. When a mass of particulate matter is drawn toward the stoppage eliminator, however, the bulk of the material will fall beneath the raised extension, permitting only so much material as can pass through the flow passage to flow with the airstream.

The next element in the output system is a mixing chamber 28, a void area immediately rearward from the stoppage eliminator. In this chamber, the airflow swirls and eddies, insuring uniform entrainment.

The airflow is delivered to the user by output filter 30, which has longitudinal flow passages 32 formed in its periphery. The output filter, which may be composed of cellulose acetate or similar suitable material, cooperates with intake filter 14 to govern the overall draft of the product. The flow passages permit a metered quantity of particulate matter to flow at the periphery of the filter, as shown in FIG. 1. Such flow passages could be located in any selected number at any selected position on or in the output filter, but it has been found that the combination of a central flow passage in the stoppage eliminator 24, a mixing zone 28, and peripheral flow passages 32 in the output filter results in excellent delivery of particulate matter.

Airflow through this embodiment of a flavor delivery system is shown by arrows A in FIG. 1. At the intake end 13, airflow occurs primarily through central bore 16 in intake filter 14. This flow emerges from the intake filler as a thin jet of high-velocity air which impinges on particulate matter 22, causing particulate matter to become entrained in the airflow. This flow continues through central passage 26 and the stoppage eliminator 24, emerging into the mixing chamber 28. The flow emerges from output end 15 through peripheral flow passages 32 in output filter 30.

Another embodiment 100 is shown in FIG. 2. There, container overwrap 102 may be a foil-lined paper tube constructed to give the appearance and feel of a conventional cigarette. An intake filter 104, of cellulose acetate or other suitable material, is positioned in the intake end 101 of the tube to limit airflow.

A particulate chamber 106 is defined by the intake filter 104 and the output means, discussed below. Within the particulate chamber and spaced rearwardly from the intake filter is a baffle chamber assembly 108, which is tubular, having a diameter slightly smaller than that of the inside diameter of the overwrap. This baffle chamber is held in position and supported by support members 113, which perform the dual functions of holding the chamber in place and providing a path for airflow around the baffle chamber. One design for such supports can be seen in greater detail in FIG. 3. In that design, the supports are diamond-shaped projections raised from the baffle chamber body. The supports are spaced slightly apart, leaving an airflow passage 111 between each set of supports so that clear air, not having particulate matter entrained therein, can flow along the pathways indicated by arrows B. The size and spacing of the raised supports can be selected by those in the art to provide a selected airflow around the baffle chamber. As those in the art will appreciate, supports for the baffle chamber may be designed in a number of configurations, given the calculated airflow requirements.

Within the chamber are located several sets of baffles 110, which create a turbulent airflow through the baffle chamber. Unlike the previous embodiment, which entrained particulate matter in the airflow by impinging a stream of high-velocity air directly upon the particulate matter, this embodiment creates a highly turbulent flow, which itself entrains the particles. Various baffle shapes, with baffles grouped in sets of differing number, could be used by those in the art to accomplish this purpose. It is preferred, however, to employ baffles aligned normal to the chamber axis, each baffle covering an area slightly greater than half the area of a plane normal to the chamber axis, the top of each baffle being a chord parallel to and above the horizontal center line of the chamber. Baffles are staggered, with the solid portion of one opposing the open portion of the other, causing the air path to change direction often, and the airflow to become exceedingly turbulent. It has been found that two sets, comprising four baffles each, is sufficient to produce the desired turbulence in the baffle chamber airflow. Airflow through the baffle chamber is shown by arrows C. The sets of baffles are positioned at either end of the baffle chamber, leaving a void area between them, in which a quantity of particulate matter 112 is placed. The quantity and characteristics of this mass of particulate matter are the same as discussed above.

The output means of this embodiment includes a mixing chamber 117 and a disperser 114. The mixing chamber lies immediately abaft the baffle chamber and allows the two airstreams—the clear airstream B flowing around the periphery of the baffle assembly through passages 111 and the entraining airstream C flowing through the baffle assembly—to mix thoroughly, insuring a uniform dispersion of particulate matter.

The disperser 114 combines the functions of eliminating stoppages, limiting the airflow, and dispersing the output. This device is generally cylindrical, fitting against the interior surface of the output end 116 of the tube. A cylindrical raised portion 115 extends into the mixing chamber and an air passage 118 extends lengthwise through the disperser. These elements cooperate in eliminating stoppages, as discussed above. As in the previous embodiment, these elements may be coaxial to prevent position bias. An indentation 120, preferably generally conical, is formed in the output end of the disperser. As the airstream flows through air passage 118 and into the indentation, it is given an outwardly expanding characteristic, which persists as the airstream emerges from the device, as shown by arrows D. It has been found that this characteristic leads to improved taste perception by the user. The disperser can be fabricated from plastic or other suitable materials known to the art.

The configuration of the baffles carried in the baffle chamber assembly may be altered in various ways apparent to those in the art, given the objective of producing turbulent flow at a calculated flow rate. Examples of alternate baffle configurations are a baffle having an upwardly projecting central portion, as seen in FIG. 4*a*, a baffle having a cutout central portion, shown in FIG. 4*b*, a baffle having several cutout portions, as seen in FIG. 4*c*, and the triangular baffle shown in FIG. 4*d*. The baffles in a given assembly may be uniformly shaped or chosen from a variety of shapes, as desired. It should be borne in mind, however, that baffles should be arranged so that no straight path of airflow exists, in order to create maximum turbulence in the airflow.

A beneficial characteristic of all of the embodiments of the present invention is that the airflow emerging from the output end of the device, with particulate matter entrained therein, closely resembles the visual appearance of cigarette smoke. It has been found that the appearance of smoke, particularly when exhaled by the user, provides a psychological benefit to users. Thus, the present invention goes beyond devices which deliver flavor characteristics but fail to deliver an approximation of the smoke derived from a conventional cigarette.

Design criteria for the total airflow system of whichever embodiment is selected must be based upon the goal of approximating the draft of a conventional cigarette. Those skilled in the art will appreciate the pressure drop requirements which must be met in order to achieve this goal and will be familiar with techniques to achieve same.

Modification in the elements shown, as well as hybrid combinations of these elements, can be made to produce other embodiments of the present invention. For example, FIG. 5 shows an airflow control element 150, formed from a cellulose acetate or other filter plug material 152 overwrapped with a plastic corrugated film 154, dimensioned to fit the inside surface of the overwrap. This element could be substituted, for example, for the intake or output filters 14 or 30 of the first embodiment, or for the intake filter 104 of the second embodiment. Similarly, the filters 30, 14, (FIG. 1) or 104 (FIG. 2) could be altered as known in the art, given the flow and draft requirements easily specified by one having skill in the art. Also, the entire configuration could be altered by substituting, for example, a different container for the overwrap, to produce an embodiment resembling a pipe or hookah. None of these or other similar variations departs from the scope of the present invention.

We claim:

1. A flavor delivery system, comprising:

a container encasing the system and defining a path of airflow between an intake end and an output end;

a quantity of particulate matter which is transferable into said airflow and contained within said container; and means for entraining said particulate matter with said airflow, whereby the user of the system receives the sensory stimulation.

2. The flavor delivery system of claim 1, wherein said container is an overwrap.

3. The flavor delivery system of claim 2, wherein said entraining means includes:

intake means, disposed at said intake end, for limiting said airflow;

output means, disposed at said output end, for delivering said airflow through said output end;

a particulate chamber within said overwrap, defined by said intake means and said output means; and means for entraining said particulate matter in said airflow.

4. The flavor delivery system of claim 3, wherein said entraining means includes:

means for impinging a stream of high-velocity air upon said particulate matter.

5. The flavor delivery system of claim 4, wherein said impinging means is one or more air passages through said intake means.

6. The flavor delivery system of claim 5, wherein said air passage is a single passage.

7. The flavor delivery system of claim 6, wherein said passage is coaxial with said intake means.

8. The flavor delivery system of claim 3, wherein said entraining means includes:

means for creating turbulence in said airflow.

9. The flavor delivery system of claim 8, wherein said turbulence means includes a plurality of baffles in spaced relation between said intake means and said output means.

10. The flavor delivery system of claim 9, wherein said baffles are disposed at angles to said airflow.

11. The flavor delivery system of claim 8, wherein said turbulence means includes:

a baffle chamber, carried within said particulate chamber, said baffle chamber having support means for bearing against the inner surface of said overwrap and for defining a peripheral path of airflow around said baffle chamber; and a plurality of baffles in spaced relation within said baffle chamber, said baffles being staggered to define a non-linear flow path through said baffle chamber.

12. The flavor delivery system of claim 11, wherein:

said baffles are arranged in sets within said baffle chamber; and said particulate matter is carried within said baffle chamber.

13. The flavor delivery system of claims 8, 10, 11, or 12, wherein said output means includes:

a mixing chamber abaft said turbulence means; and a disperser, having a path of limited flow communicating between said mixing chamber, and an indentation in the output end of said disperser, whereby said airflow carrying said entrained particulate matter exits said output end having an expanding flow characteristic.

14. The flavor delivery system of claim 13, wherein said indentation is generally conical.

15. The flavor delivery system of claims 3, 4, 8, 5, 6, or 7, wherein said intake means is a filter.

16. The flavor delivery system of claim 4, wherein said output means includes:

means for eliminating stoppages in said airflow and metering the quantity of particulate matter; and means for delivering said airflow through said output end.

17. The flavor delivery system of claim 16, wherein said output means further includes a mixing chamber, whereby said particulate matter is thoroughly mixed in said airflow.

18. The flavor delivery system of claim 17, wherein said eliminator means is cylindrical in form and carried in said overwrap abaft said particulate chamber, having a raised central portion extending into said particulate chamber, with a flow passage extending lengthwise therethrough.

19. The flavor delivery system of claim 18, wherein said eliminator flow passage and said raised central portion are coaxial with said eliminator means.

20. The flavor delivery system of claim 16, wherein said delivery means is a filter plug carried in said output end, having at least one flow passage therethrough.

21. The flavor delivery system of claim 20 wherein said filter plug carries a plurality of said flow passages.

22. The flavor delivery system of claim 21, wherein said flow passages are formed in the periphery of said filter plug, spaced equidistantly thereon.

23. A device for delivering flavorant in powdered form comprising:

a tube, defining a flow path, having an intake end and an output end;

intake flow limiting means, disposed at said intake end;

output flow limiting means, disposed at said output end;

a powder chamber within said tube, between said intake limiting means and said output limiting means and containing powder which is transferable into said flow; and means for entraining said powder in said flow.

24. A flavor delivery system comprising:

an overwrap, tubular in form, having appearance and tactile characteristics of a conventional cigarette, having an intake end and an output end;

an intake filter element, disposed in said intake end, having at least one air passage passing therethrough;

a particulate matter chamber abaft said filter element;

a quantity of particulate matter within said chamber;

a stoppage eliminator adjacent said chamber, generally cylindrical in form, having a raised central portion projecting into said chamber, a body portion bearing against the inner surface of said overwrap, and a flow passage passing longitudinally therethrough, whereby stoppages are precluded and the quantity of particulate matter in said airflow is metered;

a mixing chamber abaft said eliminator; and a filter element disposed in said output end, having at least one air passage therethrough, whereby the application of negative pressure at said output end causes a high-velocity stream of air from said intake filter air passage to impinge upon said particulate matter, entraining particulate matter in said airflow.

25. A flavor delivery system, comprising:

a body, tubular in form, defining a path of airflow having an intake end and an output end;

an intake filter element, disposed in said intake end;

a baffle chamber adjacent said intake filter, spaced from the inner surface of said body by support members projecting from said baffle chamber, said support members defining a peripheral flow path around said baffle chamber;

a plurality of baffles carried within said baffle chamber, said baffles staggered to define a non-linear flow path through said baffle chamber, whereby turbulence is created in said flow through said baffle chamber;

a mixing chamber abaft said baffle chamber;

a disperser, disposed in said output end, having an indentation in the end thereof toward said output, a raised central portion in the opposite end thereof, projecting into said mixing chamber, and an air passage communicating between said indentation and said mixing chamber, whereby stoppages are precluded and the airflow exiting said output end has an expanding flow characteristic.

* * * * *